US006882316B2

(12) United States Patent
McKinzie, III et al.

(10) Patent No.: US 6,882,316 B2
(45) Date of Patent: Apr. 19, 2005

(54) DC INDUCTIVE SHORTED PATCH ANTENNA

(75) Inventors: William E. McKinzie, III, Fulton, MD (US); Greg S. Mendolia, Ellicott City, MD (US); John Dutton, Columbia, MD (US)

(73) Assignee: Actiontec Electronics, Inc., Sunnyvale, CA (US)

( * ) Notice: Subject to any disclaimer, the term of this patent is extended or adjusted under 35 U.S.C. 154(b) by 0 days.

(21) Appl. No.: 10/242,087

(22) Filed: Sep. 12, 2002

(65) Prior Publication Data

US 2003/0137457 A1 Jul. 24, 2003

Related U.S. Application Data

(60) Provisional application No. 60/354,003, filed on Jan. 23, 2002.

(51) Int. Cl.[7] ..... H01Q 1/38
(52) U.S. Cl. ..... 343/700 MS; 343/909
(58) Field of Search ..... 343/700 MS, 909

(56) References Cited

U.S. PATENT DOCUMENTS

| | | | | |
|---|---|---|---|---|
| 3,290,688 | A | * 12/1966 | Kraus | 343/731 |
| 4,053,895 | A | * 10/1977 | Malagisi | 343/700 MS |
| 4,063,245 | A | * 12/1977 | James et al. | 343/700 MS |
| 4,074,211 | A | 2/1978 | Bates | |
| 4,151,476 | A | 4/1979 | Jasper, Jr. | |
| 4,329,689 | A | 5/1982 | Yee | 343/700 |
| 4,376,938 | A | * 3/1983 | Toth et al. | 343/700 MS |
| 4,937,585 | A | * 6/1990 | Shoemaker | 343/700 MS |
| 5,483,246 | A | 1/1996 | Barnett et al. | |
| 5,786,793 | A | 7/1998 | Maeda et al. | 343/700 |
| 5,936,587 | A | 8/1999 | Gudilev et al. | |
| 6,049,305 | A | 4/2000 | Tassoudji et al. | 342/357.16 |
| 6,094,170 | A | 7/2000 | Peng | |
| 6,181,280 | B1 | 1/2001 | Kadambi et al. | 343/700 |
| 6,373,440 | B1 | 4/2002 | Apostolos | |
| 6,380,900 | B1 | 4/2002 | Kanayama | |
| 6,452,548 | B1 | 9/2002 | Nagumo et al. | |
| 6,476,771 | B1 | 11/2002 | McKinzie, III | |
| 2002/0024473 | A1 | 2/2002 | Thursby et al. | |
| 2002/0118142 | A1 | 8/2002 | Wang | |
| 2002/0149521 | A1 | 10/2002 | Hendler et al. | |
| 2003/0011518 | A1 | 1/2003 | Sievenpiper et al. | |

OTHER PUBLICATIONS

International Search Report for international patent application No. PCT/US02/35797.

Written Opinion for international patent application No. PCT/US02/35797.

Chang, Chin–Chang et al., "Numerical And Experimental Characterization of Slow–Wave Microstrip Line On Periodic Ground Plane", *IEEE*, 2000, 4 pages.

Elamaran, Balasundaram et al., "A Beam–Steerer Using Reconfigurable PBG Ground Plane", *IEEE*, 2000, 4 pages.

Fries, Matthias K. et al., "Small Microstrip Patch Antenna Uisng Slow–Wave Structure", *IEEE*, 2000, pp770–773.

Remski, Richard, "Analysis of Photonic Bandgap Surfaces Using Ansoft HFSS", *Microwave Journal*, 2000, pp 190–198.

(Continued)

*Primary Examiner*—Michael C. Wimer
(74) *Attorney, Agent, or Firm*—Luce, Forward, Hamilton & Scripps LLP

(57) ABSTRACT

A direct current (DC) inductive shorted patch antenna includes a direct current inductive (DCL) frequency selective surface (FSS) forming the radiating element, a ground plane, a feed, and a radio frequency (RF) short to the ground plane positioned between the feed and the radiating element.

17 Claims, 7 Drawing Sheets

OTHER PUBLICATIONS

Remski, Richard, "Modeling Photonic Bandgap (PBG) Structures Uisng Ansoft HFSS 7 and Optimetrics", *Ansoft HFSS International Roadshow*, 2000, 43 pages.

Sievenpiper, D. et al., "Antennas on High–Impedance Ground Planes," *IEEE Intl. MTT Symp.*, Jun. 13–19, 1999, Anaheim, CA., 4 pages.

Sievenpiper, D. et al., "High–Impedance Electromagnetic Ground Planes," *IEEE Intl. MTT Symp.*, Jun. 13–19, 1999, Anaheim, CA., 4 pages.

Sievenpiper, D. et al., "High–Impedance Electromagnetic Surfaces With A Forbidden Frequency Band," *IEEE Trans. Microwave Theory and Techniques*, vol. 47, No. 11, Nov. 1999, pp. 2059–2074.

Xue, Quan et al., "A Novel Low–Lass Slow–Wave Microstrip Structure", *IEEE Microwave and Guided Wave Letters*, vol. 8, No. 11, 1998, pp 372–374.

Xue, Quan et al., "Novel 1–D Microstrip PBG Cells", *IEEE Microwave and Guided Wave Letters*, vol. 10, No. 10, 2000, pp 403–405.

Yang, Fei–Ran, "A Uniplanar Compact Photonic–Bandgap (UC–PBG) Structure and Its Applications For Microwave Circuits", *IEEE Transactions On Microwave Theory and Techniques*, vol. 47, No. 8, 1999, pp 1509–1514.

International Preliminary Examination Report for application serial number PCT/US02/35797, dated Apr. 6, 2004.

* cited by examiner

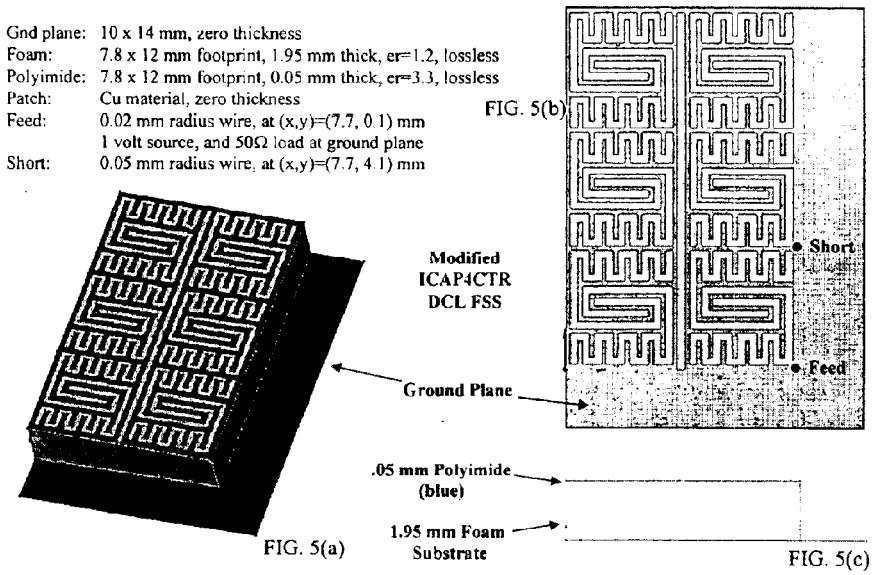
FIG. 5
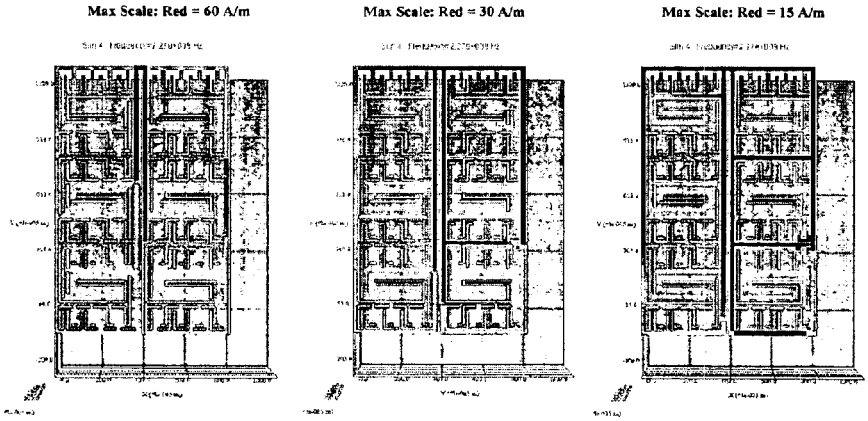
FIG. 6(a) FIG. 6(b) FIG. 6(c)
FIG. 6

DC INDUCTIVE SHORTED PATCH ANTENNA

RELATED APPLICATIONS

This application claims priority of U.S. Provisional Patent application Ser. No. 60/354,003 filed Jan. 23, 2002. This application is related to U.S. Provisional Patent Application Ser. No. 60/352,113 filed Jan. 23, 2002 and Provisional Patent application Ser. No. 60/354,697 filed Feb. 4, 2002 in the names of Greg S. Mendolia, John Dutton and William E. McKinzie III and entitled "MINIATURIZED REVERSE-FED PLANAR INVERTED-F ANTENNA, which applications are hereby incorporated herein by reference in their entirety. This application is related to U.S. Provisional Patent Application Ser. No. 60/310,655 filed Aug. 6, 2001 in the names of William E. McKinzie III, Greg S. Mendolia and Rodolfo E. Diaz and entitled "LOW FREQUENCY ENHANCED FREQUENCY SELECTIVE SURFACE TECHNOLOGY AND APPLICATIONS," which application is incorporated herein by reference in its entirety.

BACKGROUND

The present invention relates generally to antennas. More particularly, the present invention relates to a reverse-fed planar inverted F-type antenna (PIFA).

Each generation of communication devices is designed to be physically smaller than the previous generation. Small size is desirable to reduce physical size and weight and enhance user convenience. Many communication devices are designed and manufactured for consumer use. These include wireless devices such as radiotelephone handsets, handheld radios, personal digital assistants and lap top computers. Like all consumer products, these devices must be designed for low cost manufacturing and operation.

Manufacturers of wireless devices such as handsets, PDA's and laptops have very little room in their products given these extreme size and cost pressures. All of these devices require an antenna for wireless communication. These devices often need multiple antennas for operation at various frequency bands. It is desirable to incorporate the antenna within the package or case for reasons of esthetics, durability and size.

Such wireless devices typically pack a substantial amount of circuitry in a very small package. The circuitry may include a logic circuit board and an RF circuit board. The printed circuit board can be considered a radio frequency (RF) ground to the antenna, which is ideally contained in the case with the circuitry. Thus, the ideal antenna would be one that can be placed extremely close to such a ground plane and still operate efficiently without adverse effects such as frequency detuning, reduced bandwidth, or compromised efficiency. The antenna solution must also be cost effective for use in a consumer product.

A variety of other antennas having small profiles have been developed. These include Planar Inverted-F Antennas (PIFAs), types of shorted patches, and various derivatives which may contain meander lines. To date, however, none of these antennas satisfy the present design goals, which specify efficient, compact, low profile antennas whose height is at most $\lambda/60$ above a ground plane, where $\lambda$ is the frequency of interest. There is a particular need for a 2.4 GHz antenna whose maximum height is at most 2 to 3 mm above a ground plane, and is thus well suited to devices requiring optimum performance in a compact volume, and operated according to the Bluetooth Standard, published by the Bluetooth Special Interest Group and IEEE Standard 802.11b, published by the Institute of Electrical and Electronic Engineers.

Devices for the Bluetooth Standard operate at 2.4 GHz ($\lambda$=125 mm). Existing shorted patch antennas are typically $\lambda/8$ to $\lambda/4$ in length. An antenna useful for such applications should have a length on the order of $\lambda/10$. One typical commercially available 2.4 GHz antenna is the SkyCross model 222-0463, available from SkyCross, Inc., Melbourne, Fla. This antenna has a volume of 3300 $mm^3$. The antenna useful for these applications should have a volume under 300 $mm^3$.

In addition to small size, portable devices typically are designed to be as lightweight as possible. Commercially available surface mountable 2.4 GHz antennas typically weigh 5 g or more. The SkyCross model 222-0463 has a mass of 8.9 g. The antenna useful for these applications has a mass under 1 g.

Cost must be reduced as well in these devices. Published embodiments of miniature patch antennas often use multiple layers of metal and multiple vias to create slow wave structures, such as meanderlines. One example is shown in U.S. Pat. No. 5,790,080. However, the antenna useful for these applications uses only one metal layer to construct the patch, and no vias, reducing fabrication costs.

Also, system designers want all components to be surface mountable to reduce assembly costs. But they also require low profile components to fit within available volumes. This problem is exacerbated when a ground plane is used under a surface mounted antenna, which is typically desired. Successful antennas need to be designed with the expectation of being surface mounted to a ground plane. A typical low profile 2.4 GHz antenna is the SkyCross model 222-0463, which is 3.56 mm in height. A lower height antenna is desired.

BRIEF SUMMARY

By way of introduction only, the present embodiments provide a direct current (DC) inductive shorted patch antenna. In another embodiment, an antenna including a direct current inductive (DCL) frequency selective surface (FSS) including a radiating element, a ground plane, a feed and a radio frequency (RF) short to the ground plane, positioned between the feed and the radiating element, is provided.

Yet another embodiment provides an antenna modeled by an equivalent circuit comprising a pair of coupled transmission lines, each transmission line defined by even mode and odd mode characteristic impedances and even mode and odd mode effective dielectric constants. Yet another embodiment provides an antenna including a ground plane, a foam substrate disposed on the ground plane and a polyimide layer disposed on the foam substrate. The antenna further includes metallization disposed on the polyimide layer to define capacitance and inductance to produce a resonance at one or more frequencies of interest.

The foregoing discussion of the preferred embodiments has been provided only by way of introduction. Nothing in this section should be taken as a limitation of the following claims, which define the scope of the invention.

BRIEF DESCRIPTION OF THE DRAWINGS

FIG. 5 shows a full-wave simulation model for DCL shorted patch antennas;

FIG. 6 shows simulated instantaneous currents determined using the simulation model of FIG. 5;

DETAILED DESCRIPTION OF THE PRESENTLY PREFERRED EMBODIMENTS

Figure 1:
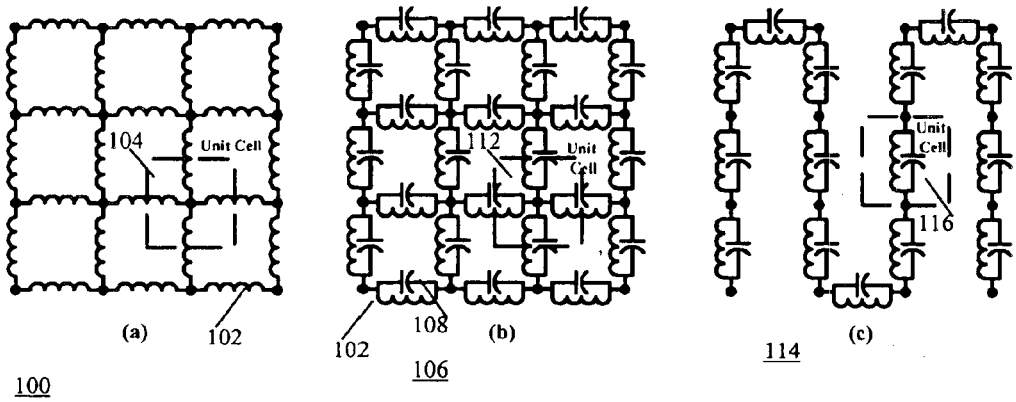
FIG. 1 illustrates equivalent circuits for direct current inductive (DCL) frequency selective surfaces.

Referring now to the drawing, FIG. 1 shows equivalent circuits for direct current inductive frequency selective surface (DCL FSS) structures. A DC inductive (DCL) frequency selective surface (FSS) is a periodic surface of conductors, which form a lattice or grid 100 of inductors as shown in FIG. 1(*a*). An example is a coplanar grid of wires intersecting at right angles. Each wire in the grid 100 may be modeled as an inductor 102 having a characteristic inductance. Further, a unit cell 104 may be defined so that the model may be dimensioned to have any suitable size.

A more detailed model 106 is shown in FIG. 1(*b*). In the model 106, capacitors 108 are added in parallel with the inductors 102 to model conditions in a real embodiment of a DCL FSS. There will always be a small amount of parasitic capacitance between the wires, which acts to shunt the inductance. Again, a unit cell 112 models the contribution of each wire to the overall DCL FSS. A DCL FSS can be designed with this intended equivalent circuit, as is the case for the example of a uniplanar compact photonic bandgap (UC-PBG) structure. See, for example, Fei-Ran Yang, Kuang-Ping Ma, Yongxi Qian, and Tatsuo Itoh, "Uniplanar Compact Photonic Bandgap (UC-PBG) Structure and Its Application for Microwave Circuits," IEEE Trans. Microwave Theory and Techniques, Vol 47, No. 8, August 1999, pp. 1509–1514. Additional background information and examples are provided in provisional patent Ser. No. 60/310,655 filed Aug. 6, 2001 in the names of William E. McKinzie III, Greg S. Mendolia and Rodolfo E. Diaz and entitled "LOW FREQUENCY ENHANCED FREQUENCY SELECTIVE SURFACE TECHNOLOGY AND APPLICATIONS," which is incorporated herein by this reference. FIGS. 1(*a*) and 1(*b*) are isotropic surfaces if the values of L and C are uniform for both in-plane directions, which means that such a surface offers the same frequency response for both horizontally and vertically polarized electric fields.

If the horizontal circuits are absent, then the frequency response is maintained only for vertical electric field polarizations, and the FSS is said to be anisotropic. However, a more complex type of anisotropy is illustrated in FIG. 1(*c*) where a meanderline 114 of unit cells 116 is formed. Now, if a ground plane is placed near this finite meanderline 114, the structure will support even and odd modes associated with coupled lines, resulting in a dual-band antenna if properly fed. In the presently disclosed embodiments, a one-turn meanderline of a DCL circuit is used.

The present embodiments relate to a miniature dual-band patch antenna. In one embodiment, the antenna is defined by several characteristic features. For example, in one embodiment, only one metal layer is used to form the patch. Also, the preferred embodiment is a single turn meanderline with two very closely coupled lines. The feed post and ground post are reversed relative to conventional shorted patch designs such that the feed post is located in the corner of the patch. The single layer of metal which forms the patch has built-in parallel inductors and capacitors which, if connected as an infinite periodic structure, behave as a DC inductive frequency selective surface. The conductive traces at the perimeter of the antenna in one embodiment have at least twice the width of interior traces in the DCL FSS unit cells. This has been shown to significantly increase radiation efficiency.

Figure 2:
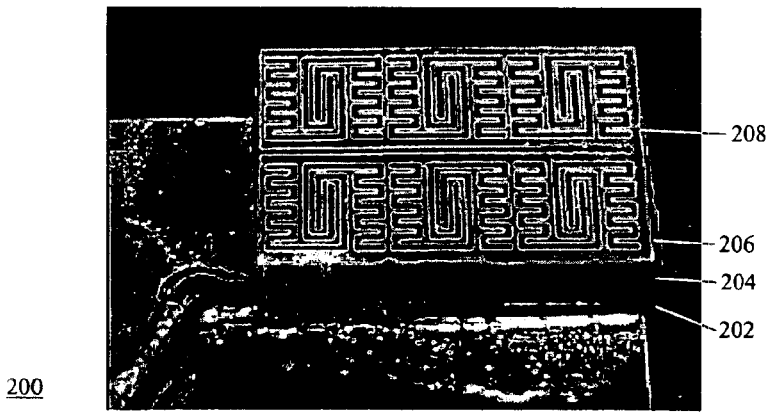
FIG. 2 is a photograph of one embodiment of a DCL shorted patch antenna.

FIG. 2 is a photograph of one embodiment of a DCL FSS shorted patch antenna 200. The antenna 200 includes a ground plane 202, a dielectric layer 204, a layer of polyimide 206 and metallization 208. Any suitable manufacturing method may be used for the antenna 200. Also, the dimensions may be varied from those shown in FIG. 2 according to performance and physical requirements. For example, the antenna 200 is generally rectangular in shape. This rectangular shape may be altered to any form factor or aspect ratio that may be required in a particular installation, as dictated by performance requirements.

The antenna 200 illustrated in FIG. 2 is fabricated by printing the metallization 208 pattern shown in FIG. 2 on a 1 mil thick layer of polyimide 206, and attaching the polyimide 206 adhesively to a 2.0 mm thick layer of foam forming the dielectric layer 204. The entire antenna 200 occupies a volume of only 8.6 mm by 12.5 mm by 2.2 mm. The polyimide may be bonded to the foam with an inexpensive pressure sensitive adhesive. This antenna 200 is then attached to the corner an FR4 ground plane 202 of typical size 45 mm×45 mm.

Figure 3:
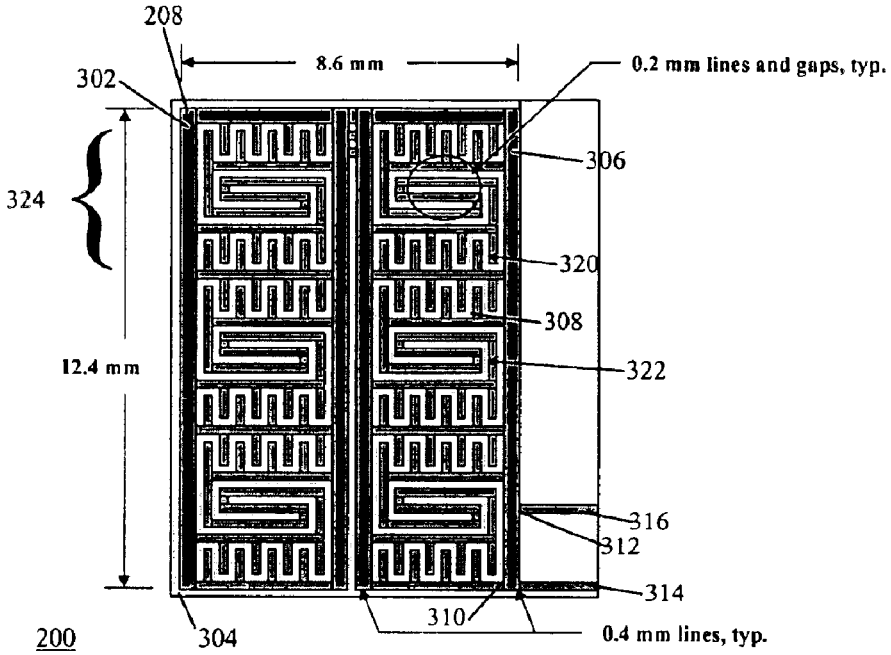
FIG. 3 is a top view of the DCL shorted patch antenna of FIG. 2.

FIG. 3 is a top view of the antenna 200 of FIG. 2. FIG. 3 shows the DCL shorted patch pattern used for the antenna 200. In FIG. 3, green areas 302 are conductor and yellow areas 304 are a flexible substrate such as polyimide.

For operation as a shorted patch antenna or planar inverted F antenna (PIFA), the metallization 208 forms a radiating element 306. The radiating element 306 has a radiating portion 308, a feed end 310 and a ground point 312. The antenna 200 includes a feed pin 314 and a radio frequency (RF) shorting pin 316. In the illustrated embodiment, the RF short 316 is positioned between the feed pin 314 and the ground point 312. This is the concept of reverse-feeding the antenna 200 which is described in greater detail in a U.S. Provisional Patent Application filed on even date herewith in the names of Greg S. Mendolia, John Dutton and William E. McKinzie III and entitled "MINIATURIZED REVERSEFED PLANAR INVERTED-F ANTENNA," which application is incorporated herein by reference. In other embodiments, a more conventional feed technique may be used in which the feed 314 is positioned between the RF short 316 and the radiating portion 308.

As shown in FIG. 2, the feed pin is a printed metal trace etched on the flexible polyimide substrate. However, any conductive structure of similar length to width ratio may be substituted such as a metal pin, post, strap, rod, screw, wire, rivet, etc. The same is true for the RF shorting pin.

The embodiment of FIG. 3 also includes both interdigitated portions such as interdigitated portion 320 and one or more meandered portions such as meandered portion 322. In the interdigitated portions, multiple fingers of metallization, shorted at one end, are positioned adjacent to other fingers, similarly shorted at one end. In the meandered portions, multiple turns of the same line of metallization are placed adjacently. Both interdigitation and meandering are useful for tailoring capacitance and inductance of the DCL FSS.

As can be seen in FIG. 3, both techniques are used repeatedly in the antenna 200 to achieve a desired performance goal. A unit cell 324 includes, at the bottom, interdigitation, and above that, a meanderline, and above the meanderline, more interdigitation. The patch is an array of such unit cells 324, two unit cells wide and three unit cells high. The illustrated embodiment is exemplary only. Other types of unit cells or configurations may be selected. The selection will depend on the materials and geometries available and performance and cost requirements. The design may be selected empirically, using simulation, or analytic evaluation.

Throughout the antenna 200, the line width and spacing may be chosen according to design rules and performance goals. In the embodiment of FIG. 3, most of the line widths and spacing is set at 0.2 mm. Along the four vertical traces and the one horizontal trace at the perimeter of the antenna 200, the line width is set at 0.4 mm. The wider 0.4 mm traces at the perimeter of the unit cells may be preferred in some applications because they have been shown to improve the radiation efficiency of the DCL shorted patch antenna, relative to the use of uniform 0.2 mm traces. The overall dimensions of the top surface of the antenna 200 are 8.6 mm×12.4 mm.

To improve the antenna efficiency of the DCL shorted patch antenna illustrated in FIG. 3, one may increase the line width of the perimeter traces 302 and 306, as well as the width of traces along the top perimeter, which bridges the two coupled DCL transmission lines. These traces may be up to several mm ($\lambda/40$) without significantly affecting the antenna's resonant frequency. Also, the thickness of the metal may be increased to improve the antenna efficiency.

Figure 4:
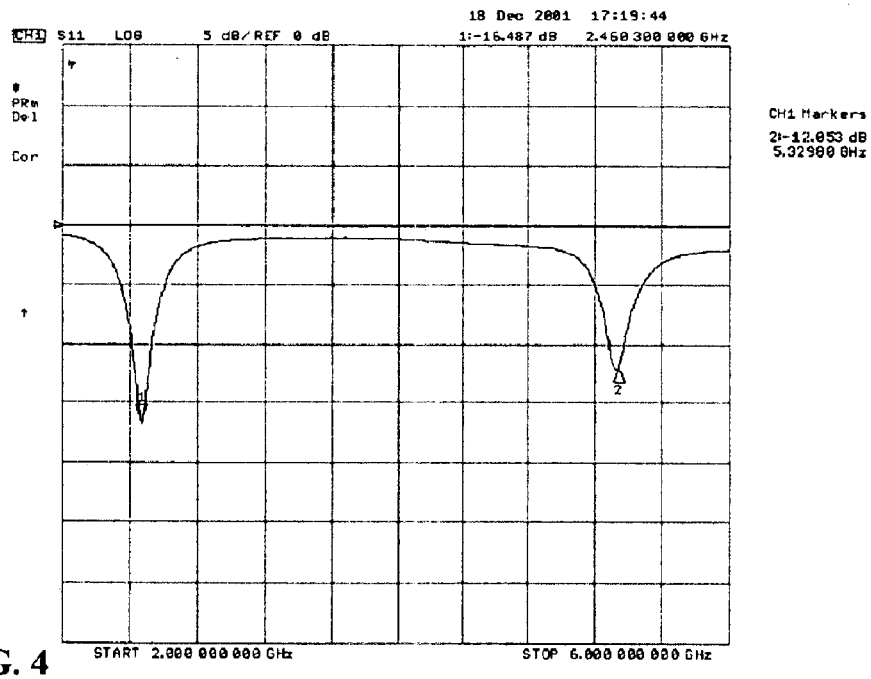
FIG. 4 shows measured return loss for the DCL shorted patch antenna of FIGS. 2 and 3.

FIG. 4 illustrates return loss for the antenna 200 of FIGS. 2 and 3. This antenna is clearly resonant at two non-harmonically related frequencies, one near 2460 MHz and another near 5330 MHz. This measurement was made with the antenna 200 mounted in the corner of a 45 mm square ground plane. Thus, this antenna 200 is well suited to address the 2.400 GHz to 2.49 GHz Bluetooth band, as well as the 802.11 wireless local area network (WLAN) bands near 5.1 to 5.3 GHz.

Test measurements on a fabricated antenna show the radiation efficiency of the preferred embodiment is typically 73% at the low band (2460 MHz) when attached to the corner of a 45 mm square ground plane. The test measurement method employed a Wheeler Cap test fixture in the form of a 3.5" square waveguide. A 7.5" square ground plane formed the bottom of the closed Wheeler Cap, and this larger ground plane was conductively connected to the 45 mm square ground plane via an SMA barrel connector. Measurements of this same antenna and ground plane setup in an antenna test chamber showed a peak radiation efficiency of 72%, which agrees to within 0.03 dB. These measured efficiencies include the line loss of the 2" coaxial cable in the test fixture, which is ~0.2 dB. Accordingly, the true antenna efficiency is near 75%.

The DCL shorted patch antenna 200 has been modeled using a full-wave simulation tool. FIG. 5 shows the computer model used for this simulation. FIG. 5(*a*) is an isometric view of the simulated antenna. FIG. 5(*b*) is a top view of the simulated antenna. FIG. 5(*c*) is a cross section view of the simulated antenna.

This model is very similar to the embodiment of FIGS. 2 and 3 with the differences being a smaller 0.2 mm line width at the antenna perimeter, and the RF short is located about twice the distance from the feed. The simulated antenna has a very small ground plane of only 10×14 mm with zero thickness, and it is excited by a series voltage source at the base of the wire which forms the feed post. This source also has a 50 Ω source impedance. Other simulation conditions specified in FIG. 5 include a foam dielectric having a footprint 7.8 mm×12 mm and thickness of 1.95 mm with $\in_r$=1.2. The poliyimide layer has a footprint 7.8 mm×12 mm and thickness of 0.05 mm with $\in_r$=3.3. The metal patch is copper with zero thickness. The feed is a wire having a radius 0.02 mm and positioned at coordinates×=7.7 mm, y=0. 1 mm. The RF short is a wire having a radius 0.05 mm and positioned at coordinates×=7.7 mm, y=4.1 mm.

Dual band operation is revealed in the simulations, with resonances near 2.27 GHz and 4.83 GHz, a ratio of 2.13. Three dimensional radiation patterns, included in the Appendix file herewith, show that the dominant polarization is right hand circular polarization at the low band, and left hand circular polarization at the high band.

FIG. 6 shows electric surface currents at the low band resonant frequency (2.27 GHz). Instantaneous currents are plotted for a given time phase of ωt~30°. The series voltage source used in the simulation has a phase angle of 0°. Each subfigure is a different maximum value for its color spectrum so as to reveal more detail in these still images. Thus, FIG. 6(*a*) shows a maximum surface current of 60 A/m; FIG. 6(*b*) shows a maximum surface current of 30 A/m; FIG. 6(*c*) shows a maximum surface current of 15 A/m.

FIG. 6 shows that the highest currents flow at the perimeter of the unit cells. Therefore, the four vertical traces are intentionally fabricated to have twice the line width of any interior lines to reduce current density in these traces. This change resulted in improving the Wheeler Cap measured radiation efficiency from the mid 50% range to the low 70% range. This is a significant improvement in efficiency for any antenna.

Figure 7:
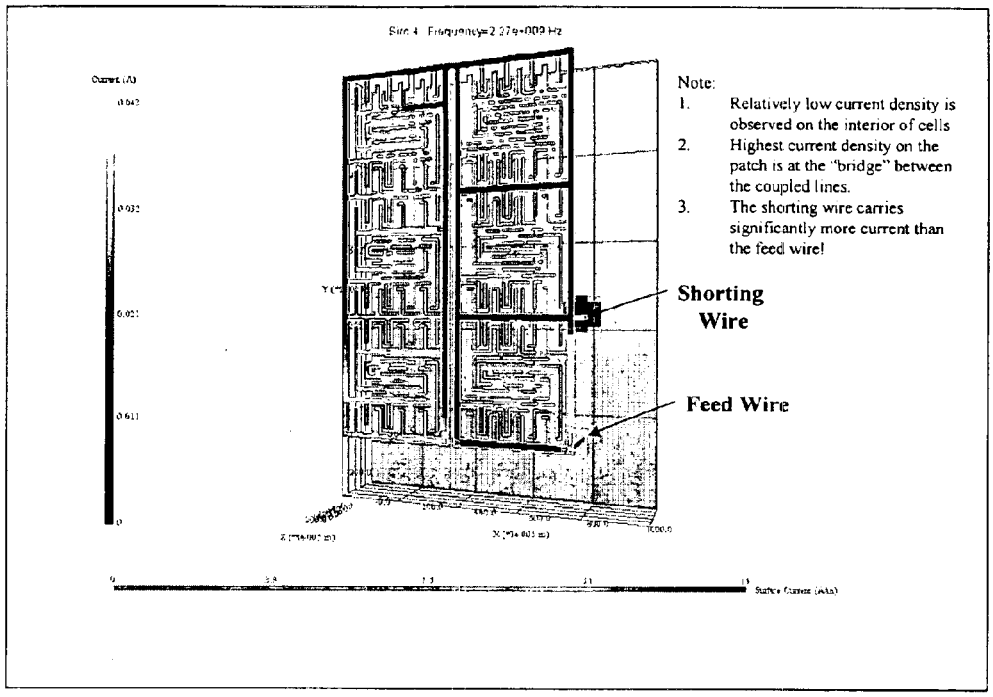
FIG. 7 shows a full-wave simulation results for the DCL shorted patch antenna modeled in FIG. 5.

FIG. 7 is another view of surface and wire currents in the simulated antenna of FIG. 5. FIG. 7 reveals that the total current in the shorting post, or shorting wire, greatly exceeds the current in the feed post. This was also highlighted in the U.S. Provisional Patent Application Ser. Nos. 60/352,113 and 60/354,697 filed on Jan. 23, 2002 and Feb. 4, 2002, respectively, in the names of Greg S. Mendolia, John Dutton and William E. McKinzie III and entitled "MINIATURIZED REVERSE-FED PLANAR INVERTED-F ANTENNA," which may be consulted for further details. Other conclusions can be drawn from the simulation results of FIG. 7. First, a relatively low current density is observed on the interior of the unit cells. Second, as may be seen in FIG. 6(*a*), the highest current density on the patch is at the bridge at the top center, where the two coupled transmission lines are joined.

Figure 8:
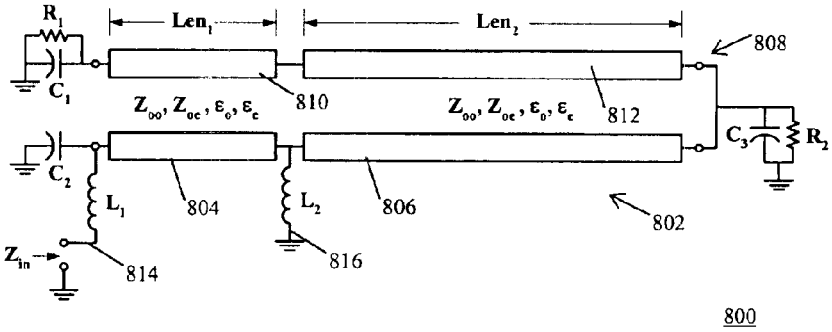
FIG. 8 shows a distributed equivalent circuit model for a DCL shorted patch antenna.

FIG. 8 shows an equivalent circuit 800 in which a DCL FSS shorted patch antenna is essentially modeled as a pair of coupled transmission lines. The equivalent circuit 800 includes a first transmission line 802 having a first segment 804 and a second segment 806. Similarly, the equivalent circuit 800 includes a second transmission line 808 having a first segment 810 and a second segment 812. The feed point 814 is located at one end of the first segment 804 of the first transmission line 802, and the RF short 816 is located at the circuit node which separates the first segment 804 from the second segment 806.

The coupled transmission lines are uniquely defined by their even mode characteristic impedance, Zoe, and their odd mode characteristic impedance, Zoo, as well as the effective dielectric constant for the even mode $\in_e$ and the odd mode $\in_o$. One benefit of a DCL patch, as illustrated herein over a solid patch, using conventional solid coupled transmission lines, is that the effective dielectric constants of the DCL patch can be increased above unity. This slows down the phase velocities of both even and odd modes on the coupled lines, and it permits the design of a more compact antenna. This is achieved without the additional cost and weight of any dielectric loading materials, but simply by patterning the transmission lines to contain a DC inductive unit cell as shown for example in FIG. 2.

Figure 9:
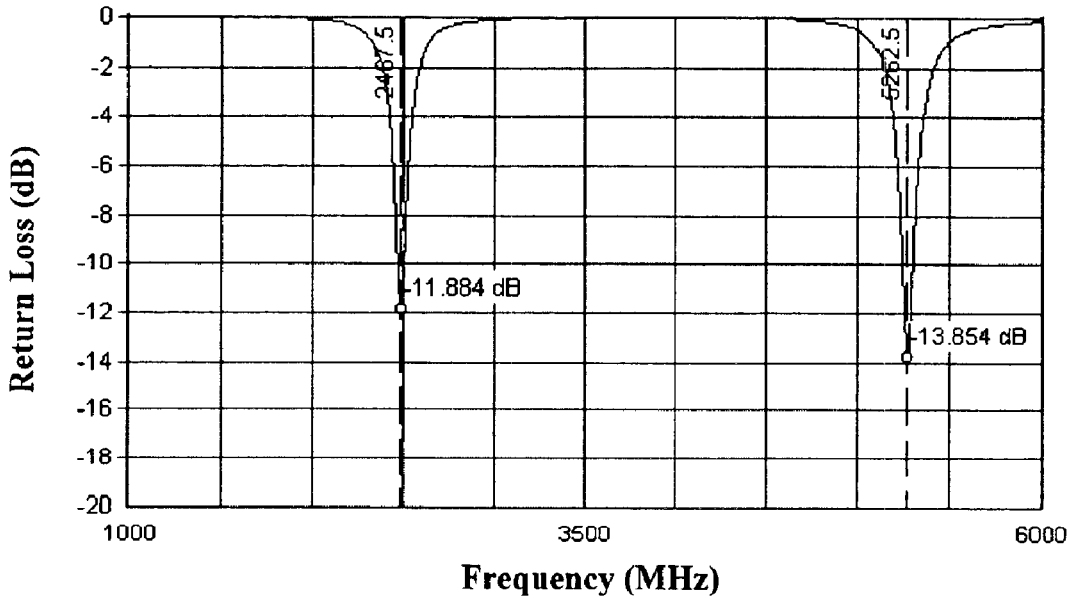
FIG. 9 shows predicted return loss for the model of FIG. 8.

As a comparison of the circuit model to measured data, the equivalent circuit 800 of FIG. 8 was modeled with the variables of the circuit model assuming the following values: $Z_{oo}$=50Ω, $Z_{oe}$=100Ω, $\in_e$=$\in_o$=1.5, $Len_1$=4 $Len_2$=8 mm, $C_1$=$C_2$=0.25 pF, $C_3$=0.47 pF, $L_1$=$L_2$=0.5 nH, $R_1$=3000Ω, $R_2$=1500Ω. Simulation results are illustrated in FIG. 9. The model predicts resonant frequencies of 2487 MHz and 5262 MHz, a ratio of 2.12, whereas the measurements described above in connection with FIG. 4 show 2460 MHz and 5330 MHz.

The proposed circuit model 800 of FIG. 8 is built on past experience of modeling simpler patch antennas. L1 and L2 represent parasitic inductances of the feed post and shorting post respectively. The lumped capacitances $C_1$, $C_2$, and $C_3$ model the fringe fields on either end of the coupled lines 802, 808. These capacitive loads are also known as radiation susceptance, and standard formulas exist to predict these values. The lumped resistors $R_1$ and $R_2$ model radiation losses, or the radiation conductance. The most difficult parameters to estimate are the coupled transmission line parameters. However, they can be found through experimental means. The merit of such a model is that parametric studies of the circuit model can provide insight and design guidance.

From the foregoing, it can be seen that the presently disclosed embodiments provide an antenna satisfying the size, weight, cost and surface installation requirements described above. This antenna in one embodiment has a maximum linear dimension of only λ/10 at the lower of the two resonant frequencies. Volume is approximately 0.00011 $\lambda^3$. This is more than an order of magnitude smaller in volume than currently commercially available antennas which are surface mountable directly on a ground plane. The absence of dielectric materials, other than the thin polyimide used to support printed traces, allows this antenna embodiment to weigh on the order of 0.25 grams or less for a 2.4 GHz antenna. It is at least 50 times lighter than commercially available antennas. The illustrated embodiment has a nominal height above the ground plane of about λ/60, and other heights are possible in other embodiments. Even the latest commercially available meander line designs are at least λ/35 in height.

Hardware experiments have shown that the DCL shorted-patch illustrated herein is not very easily detuned by changes in ground plane size or by the proximity of nearby dielectric bodies. This embodiment resonates with adequate VSWR bandwidth to be usable at multiple frequency bands, such as Bluetooth and IEEE standard 802.11 frequencies near 2.4 GHz and 5.2 GHz.

Several physical features combine to permit a very low-cost manufacturing approach. They include, first, a very small footprint, second, only one layer of patch metal is needed, third, no feed through pins are needed as this design may be fed and grounded from its perimeter, and fourth, no exotic materials are needed for the design. These characteristics are ideal for applications in wireless products such as handsets, personal digital assistants (PDAs) and laptops that are wirelessly connected to a Local Area Network (LAN) or Personal Area Network. (PAN) This technology can be scaled to various frequencies such as 800 MHz (cellular), 900 MHz (GSM), 1500 MHz (GPS) 1800 MHz (GSM), 1900 MHz (PCS), 2400 MHz (Bluetooth and IEEE standard 802.11), 5200 MHz (IEEE standard 802.11) and higher frequencies.

Figure 10:
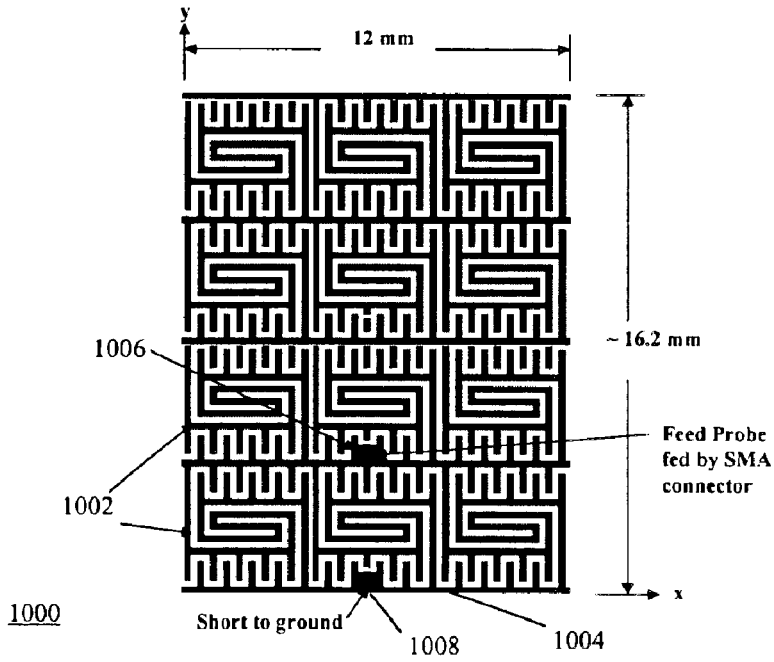
FIG. 10 shows a second embodiment of a DCL shorted patch antenna.

Alternative embodiments exist for DCL shorted patch antennas. However, the performance of such embodiments may vary from performance of the design described above. FIG. 10 shows one such embodiment of a DCL shorted patch 1000. The illustrated embodiment of the shorted patch 1000 of FIG. 10 is simpler than the earlier described embodiments because the patch 1000 is formed of essentially homogeneous unit cells 1002, and there are no coupled lines. This DCL patch 1000 is shorted at one end 1004 like a conventional PIFA. The DCL patch 1000 is fed at a feed point 1006 near the lower center of the patch 1000, as identified in FIG. 10, again similar to a conventional PIFA. As in a conventional PIFA, a grounding point 1008 is located near the end 1004 of the patch 1000.

Figure 11:
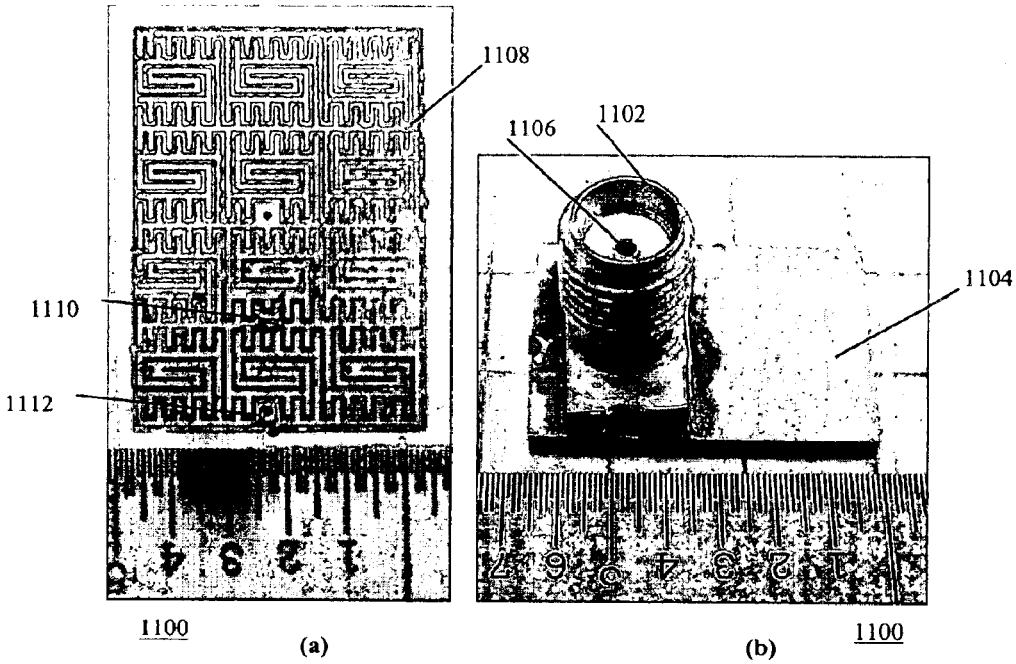
FIG. 11 shows photographs of the antenna design of FIG. 10.

FIG. 11 shows two photos of one embodiment of a DCL patch 1100. FIG. 11(*a*) shows a top view of the front side of the patch 110. FIG. 11(*b*) shows an isometric view of the ground plane side of the patch 1100. This embodiment was fabricated on double-sided 0.062" FR4 using 8 mil lines and 8 mil gaps for the DCL FSS on the front side 1108. An SMA connector 1102 is soldered to the ground plane side 1104 of the FR4, and its center coaxial conductor 1106 is extended as a feed probe through the FR4 to excite the DCL FSS. The feed pin 1110 and RF shorting pin 1112 are soldered wires.

Figure 12:
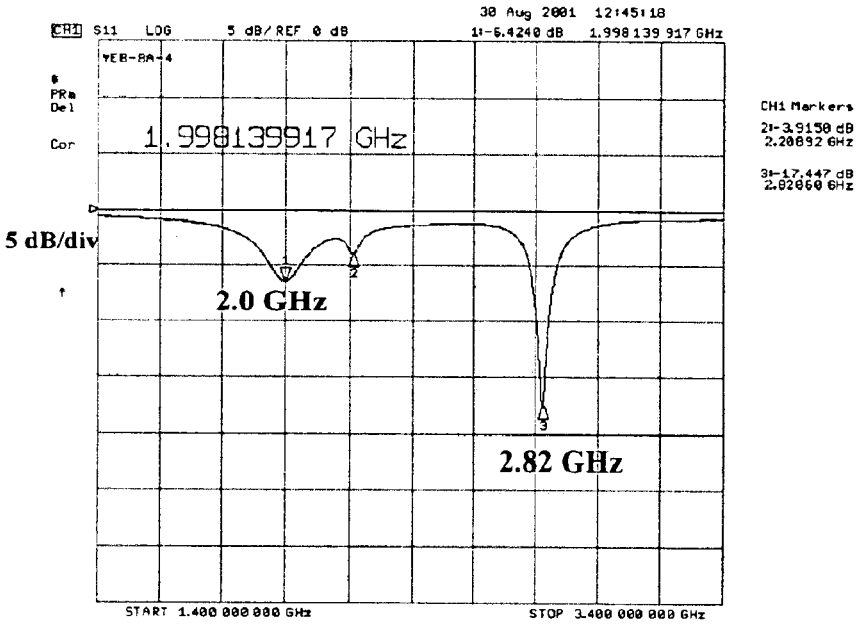
FIG. 12 shows the measured return loss for the DCL shorted patch described in FIGS. 10 and 11.

FIG. 12 shows return loss for the embodiment of a DCL patch 1100 of FIG. 11. A dual band response is seen with resonant frequencies near 2.0 GHz and 2.82 GHz. Note the ratio between resonant frequencies in this example is only 1.41:1.

The above two examples show DCL FSS materials can be used as a patch antenna in which the DCL FSS is anisotropic. In other words, x and y directed patch currents see different sheet impedances, or different equivalent circuits. Patch currents are currents flowing in the metal or other conductor on the surface of the patch. In this example, x and y axes are orthogonal and in the plane of the FSS. There are many physical realizations of anisotropic DCL FSS materials, an exemplary one of which is shown herein. However, it is possible, and perhaps desirable, to fabricate a DCL shorted patch with an isotropic DCL FSS.

Figure 13:
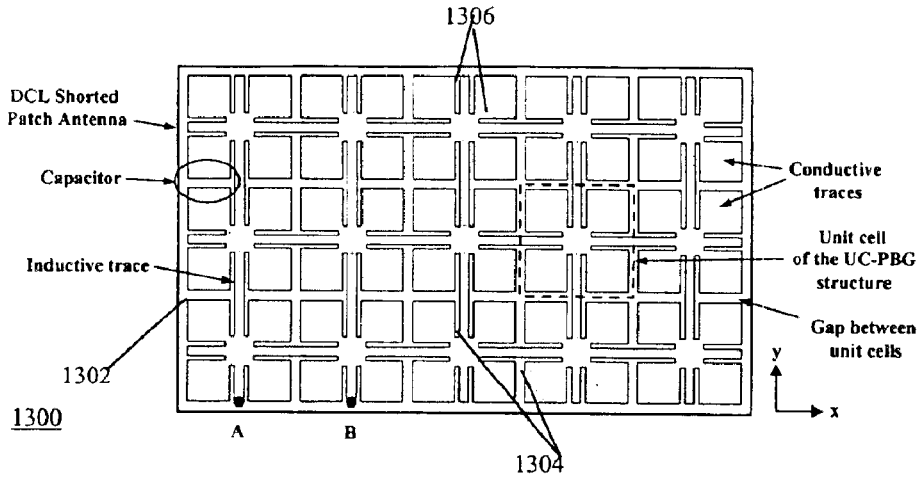
FIG. 13 shows a DCL shorted patch, which uses an isotropic DCL FSS.

FIG. 13 shows one embodiment of an isotropic DCL shorted patch 1300. In the patch 1300, a uniplanar compact photonic bandgap (UC-PBG) structure is used for the patch. This FSS pattern is also known as an array of crossed Jerusalem slots. A unit cell of the UC-PBG structure is identified in FIG. 13. As an FSS, the equivalent circuit for the patch 1300 is approximated by the circuit shown in FIG. 1(*b*). The unit cells of the patch 1300 are separated by gaps 1302 which form capacitors and traces 1304 which form inductors, as modeled by the equivalent circuit of FIG. 1(*b*). In this antenna example, the capacitive gaps 1302 between unit cells are the same size in both orthogonal directions, as are the inductive traces, or the inset gaps 1306 that define them. This symmetry yields an isotropic DCL FSS. However, the LC values can be made anisotropic by modifying the geometry independently for x and y directions.

An important point to be understood about DCL shorted patch antennas is that the unit cell of the DCL FSS is very small relative to a free-space wavelength at any antenna resonant frequency. A typical unit cell dimension for the first two embodiments is 2% to 4% of a free space wavelength for the lowest resonant frequency. Other dimensions may be used as well.

In FIG. 13, the points labeled "A" and "B" are suggested locations for the feed point and RF shorting point, respectively. A more conventional feed point is point B. A reverse-fed PIFA would exploit point A for the feed point.

Figure 14:
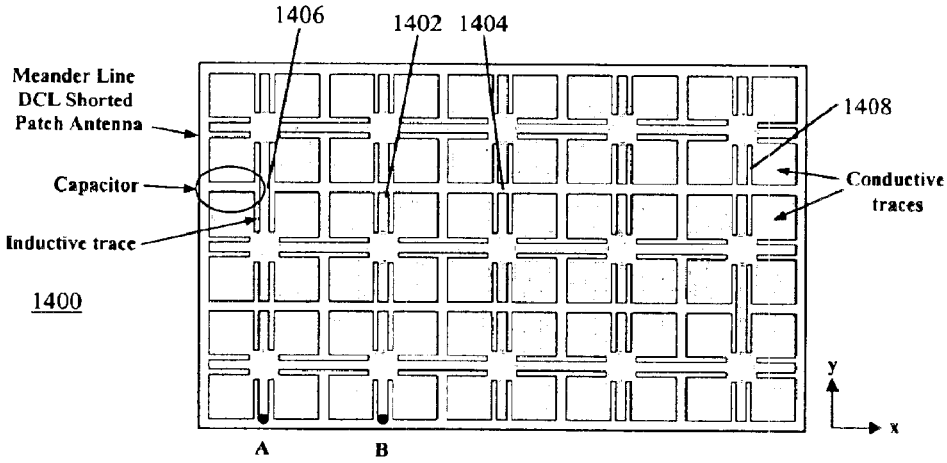
FIG. 14 shows a meander line DCL shorted patch antenna.

A modification of the embodiment of FIG. 13 yields the more sophisticated meander line DCL shorted patch antenna 1400 of FIG. 14. The antenna 1400 is obtained by simply cutting selective y-directed inductive traces. For example, traces 1402 and 1404 have been cut relative to the embodiment of FIG. 13. Traces 1406, 1408 remain intact to form a meanderline. Now the DC inductive path meanders left to right, so that the equivalent circuit of the DCL FSS may be modeled in a manner similar to the embodiment of FIG. 1(*c*), if it where rotated by 90°.

While particular embodiments of the present invention have been shown and described, modifications may be made. It is therefore intended in the appended claims to cover such changes and modifications, which follow in the true spirit and scope of the invention.

What is claimed is:

1. A patch antenna comprising:

a direct current inductive (DCL) frequency selective surface (FSS) including metallization defining a radiating element, the metallization being patterned to define a combination of one or more interdigitated portions and one or more meandered portions;

a ground plane;

a feed; and a radio frequency (RF) short from a ground point of the radiating element to the ground lane.

2. The patch antenna of claim 1 where the feed is located near a corner of the patch antenna.

3. The patch antenna of claim 1 wherein the feed is located at an end of a transmission line which models the radiating element.

4. The patch antenna of claim 1 wherein the RF short is located such that a distance from the RF short to a center of the patch antenna is less than a distance from the feed to the center of the patch antenna.

5. The patch antenna of claim 1 wherein the patch antenna is fabricated as a pair of coupled transmission lines.

6. The antenna of claim 1 wherein the DCL FSS comprises metallization disposed on a dielectric layer separating the metallization from the ground plane.

7. The antenna of claim 1 wherein the metallization is patterned to define capacitance and inductance of the DCL FSS.

8. The antenna of claim 7 wherein the metallization is patterned to define one or more interdigitated portions.

9. The antenna of claim 7 wherein the metallization is patterned to define one or more meandered portions.

10. The antenna of claim 1 wherein the antenna is resonant at two frequency bands.

11. The antenna of claim 7 wherein the metallization comprises:

surrounding metal lines having a first width; and pattern metal lines at least partly within the surrounding metal lines and having a second width.

12. An antenna modeled by an equivalent circuit comprising at least one pair of coupled transmission line sections, wherein each coupled line section is defined by even mode and odd mode characteristic impedances and even mode and odd mode effective dielectric constants, wherein the effective dielectric constants exceed unity by virtue of using printed inductors and printed capacitors instead of using medium to high dielectric constant substrate materials.

13. The antenna of claim 12 wherein a feed is located proximate the end of one of the coupled transmission line sections.

14. The antenna of claim 12 wherein an RF short to ground is located at a circuit node between sections of coupled transmission lines.

15. An antenna comprising:

a ground plane;

a foam substrate;

a flexible dielectric layer disposed on the foam substrate; and metallization disposed on the flexible dielectric layer to define capacitance and inductance to produce a resonance at one or more frequencies of interest, the metallization including one or more interdigitated structures combined with one or more meanderlines to produce the resonance at the one or more frequencies of interest.

16. The antenna of claim 15 wherein the metallization is patterned to define a radiating element including a feed end and a radiating portion.

17. The antenna of claim 16 further comprising:

a feed electrically engaging the feed end of the radiating element; and an RF short configured to electrically ground a ground point of the radiating element, the ground point positioned between the feed end and the radiating portion.

* * * * *